US006500037B1

(12) United States Patent
Hedlund et al.

(10) Patent No.: US 6,500,037 B1
(45) Date of Patent: Dec. 31, 2002

(54) SERVO STEERING MECHANISM FOR BOATS FOR EXAMPLE

(75) Inventors: Benny Hedlund, Hono (SE); Mikael Asberg, Torslanda (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 09/856,666

(22) PCT Filed: Nov. 25, 1999

(86) PCT No.: PCT/SE99/02194

§ 371 (c)(1),
(2), (4) Date: Aug. 21, 2001

(87) PCT Pub. No.: WO00/30934

PCT Pub. Date: Jun. 2, 2000

(30) Foreign Application Priority Data

Nov. 26, 1998 (SE) ..... 9804073

(51) Int. Cl.[7] ..... B63H 20/08
(52) U.S. Cl. ..... 440/61; 114/150
(58) Field of Search ..... 440/61; 114/144 R, 114/150, 154; 60/385, 386, 389, 402, 420, 421; 137/625, 625.12, 625.25, 625.65, 625.66, 625.67, 625.68, 625.69

(56) References Cited

U.S. PATENT DOCUMENTS

| | | | | |
|---|---|---|---|---|
| 2,236,467 A | * | 3/1941 | Clench | 60/384 |
| 2,479,063 A | * | 8/1949 | Forsythe | 114/150 |
| 2,667,746 A | * | 2/1954 | Kumpf et al. | 60/385 |
| 2,892,310 A | * | 6/1959 | Mercier | 60/385 |
| 3,302,604 A | * | 2/1967 | Stuteville | 114/150 |
| 3,349,744 A | * | 10/1967 | Mercier et al. | 114/150 |
| 3,384,046 A | * | 5/1968 | Stuteville | 114/150 |
| 3,508,400 A | * | 4/1970 | Mercier | 60/463 |
| 3,584,537 A | * | 6/1971 | Schulz | 91/517 |
| 3,986,475 A | * | 10/1976 | Heiser | 114/144 R |
| 4,319,609 A | | 3/1982 | Debrus | |
| 4,405,030 A | | 9/1983 | Wittren | |
| 4,592,732 A | * | 6/1986 | Ferguson | 440/61 |
| 4,749,374 A | | 6/1988 | Ferguson | |
| 4,933,617 A | * | 6/1990 | Huber et al. | 318/588 |
| 5,427,045 A | * | 6/1995 | Fetchko | 114/150 |
| 5,471,907 A | | 12/1995 | Kobelt | |
| 5,775,102 A | * | 7/1998 | Frye et al. | 60/431 |
| 5,782,195 A | * | 7/1998 | Kobelt | 114/162 |
| 5,857,488 A | * | 1/1999 | Kobelt | 137/596 |

FOREIGN PATENT DOCUMENTS

| | | |
|---|---|---|
| GB | 2 125 902 | 3/1984 |

* cited by examiner

*Primary Examiner*—S. Joseph Morano
*Assistant Examiner*—Ajay Vasudeva
(74) *Attorney, Agent, or Firm*—Young & Thompson

(57) ABSTRACT

Servo-assisted steering arrangement for an element pivotable about a steering axis, for example a propeller drive means suspended on a boat transom, said drive means driving a pair of hydraulic steering cylinders (20*a*, 20*b*) which connect the drive means to the transom. A manually driven low pressure pump (39), for example a steering wheel pump, communicates both with a cylinder chamber (70, 71) in each steering cylinder (20*a*, 20*b*) and with a control valve (36). A motordriven high pressure pump (41) communicates via the control valve with the other cylinder chamber (72, 73) in each steering cylinder. The control valve is disposed so that, when the low pressure pump is driven, it opens a communication both between the pressure side (40) of the high pressure pump and a cylinder chamber (72) in the one cylinder (20*b*) and between the return side (42) and the corresponding cylinder chamber (73) in the other cylinder.

14 Claims, 6 Drawing Sheets

SERVO STEERING MECHANISM FOR BOATS FOR EXAMPLE

BACKGROUND OF THE INVENTION

The present invention relates to a servo-assisted steering arrangement for an element pivotable about a steering shaft, comprising, in a hydraulic circuit, a first hydraulic pump driven by a manual drive means, at least two double-acting hydraulic piston cylinder devices connected in tie hydraulic circuit, each having a cylinder chamber on either side of the respective pistons, said piston cylinder devices being connected between the pivotable element and another element and a second hydraulic pump coupled into the hydraulic circuit, said second hydraulic pump being driven by a drive motor, the hydraulic circuit being divided into two, at least essentially mutually separated first and second partial circuits with a first hydraulic pump in the first partial circuit and a second hydraulic pump in the second partial circuit.

DESCRIPTION OF THE RELATED ART

GB 2 159 482, for example, discloses a servo-assisted steering arrangement of the above type for pivoting an outboard motor about a vertical steering axis. The steering arrangement comprises a pair of piston cylinder devices, which are mounted between the ends of a steering arm joined to the engine propeller rig and mounting brackets on the boat hull. The piston rod of one of the piston cylinder devices is mechanically joined to a valve slide in a control valve, the valve housing of which is joined to a steering arm connected to the propeller rig. The control valve thus forms a mechanical connection between the piston rod of the first piston cylinder device and the propeller rig. The cylinder chambers on either side of the associated piston communicate with a steering wheel pump, which, when the steering wheel is turned, pumps hydraulic fluid to one or the other cylinder chamber, depending on the rotational direction of the steering wheel. The circuit, including the steering wheel pump and the first piston cylinder device, forms a low pressure circuit which is separate from a high-pressure circuit in which the control valve is coupled between a motor-driven hydraulic pump and the second piston cylinder device.

When the steering wheel is turned, oil is pumped into one cylinder chamber in the associated piston cylinder device, and at the same time the opposite cylinder chamber is drained. Initially, this leads to a displacement of the valve slide from its closed neutral position to one of its open lateral positions, in which a communication is established between the motor-driven pump and the opposite cylinder chamber in the second piston cylinder device, which leads to displacement of the piston in the opposite direction, which in turn results in the valve housing being displaced in the same direction as the valve slide during the steering movement. As long as the steering wheel is turned, the slide and the housing move together with the slide in the open position. When the turning of the steering wheel and the slide movement stops, the valve closes after a short displacement of the valve housing relative to the slide. The system described thus has a mechanical feedback, which requires that the control valve be movable together with the piston rod of the associated piston cylinder device. One disadvantage of a system with this function, i.e. initial turning of the steering wheel only takes up play and does not result in any steering forces, is that the driver will experience a marked looseness in the system when turning the steering wheel. Another disadvantage is that the total length of the piston cylinder device and the control valve makes it necessary that the distance between the mountings in the boat hull and in the propeller rig be relatively large- which makes it impossible to use the service device described together with certain marine drive units, e.g. an outboard drive unit of the type shown in SE 501 147 (U.S. Pat. No. 5,562,508).

BRIEF DESCRIPTION OF THE INVENTION

The purpose of the present invention is to achieve a servo-assisted steering device of the type described by way of introduction, which is experienced as being virtually without play and which permits placement of the control valve independently of the placement of the piston cylinder device.

This is achieved to the invention by virtue of the fact that the partial circuits are so connected to the control valve means and to their individual pair of cylinder chambers that the flow in the first partial circuit is directed to one cylinder chamber of the associated pair of cylinder chambers via the control valve means, which at a predetermined pressure open the communication between the second hydraulic pump and one of the cylinder chambers of the associated pair of cylinder chambers, so that the pistons in the respective piston-cylinder devices are displaced in a direction dependent on the flow direction in the first partial circuit.

By controlling the flow from the steering wheel pump parallel to a steering cylinder and to the control valve, a maneuver pressure is achieved immediately in the cylinder striving to pivot the pivotable elements coupled to the cylinders. No play arises on the order of magnitude which is unavoidable in the described known system, in which the hydraulic cylinder coupled to the steering wheel pump only steers a slave cylinder. The servo-assisted steering arrangement according to the invention therefore provides the driver with a better steering feeling and control over the boat. Since the feedback between the steering cylinders, the control valve and the steering wheel pump is completely hydraulic, the control valve can be mounted wherever desired in the boat, which means that it will not, as with the control valve in the described known servo arrangement encroach on the space available for the steering cylinders.

One particular example of a control valve suitable for the steering arrangement according to the invention comprises a valve housing, a valve slide which is displaceable in said housing and which is spring-biased towards a neutral position, in which it breaks the communication between the inlet to and the outlet from the valve housing and a control piston which is joined to the valve slide and is displaceable in a cylinder in the valve housing, said cylinder having, on opposite sides of the control piston, cylinder chambers, each having an inlet and an outlet so that a pressure in either cylinder chamber strives to displace the control piston and thus the valve slide to one of two open positions.

A control valve of this type, which, in a control circuit for a steering device according to the invention, permits manual emergency steering in the event of pressure failure on the high pressure side, is characterized in that the valve slide in one of said two positions establishes communication between a valve housing inlet intended to be connected to the high pressure side in a hydraulic circuit, and one of two connections intended to be connected to individual pressure medium-actuated devices, at the same time as communication is established between the second connection and an outlet from the valve housing intended to be connected to the low pressure side of the hydraulic circuit, non-return valve means arranged in the valve housing permitting, if there is pressure failure on the high pressure side, flow from the low pressure side to the high pressure side when the pressure on the low pressure side exceeds the pressure on the high pressure side.

BRIEF DESCRIPTION OF THE DRAWINGS

The invention will be described in more detail with reference to examples shown in the accompanying drawings, where.

DESCRIPTION OF THE PREFERRED EMBODIMENTS

Figure 1:
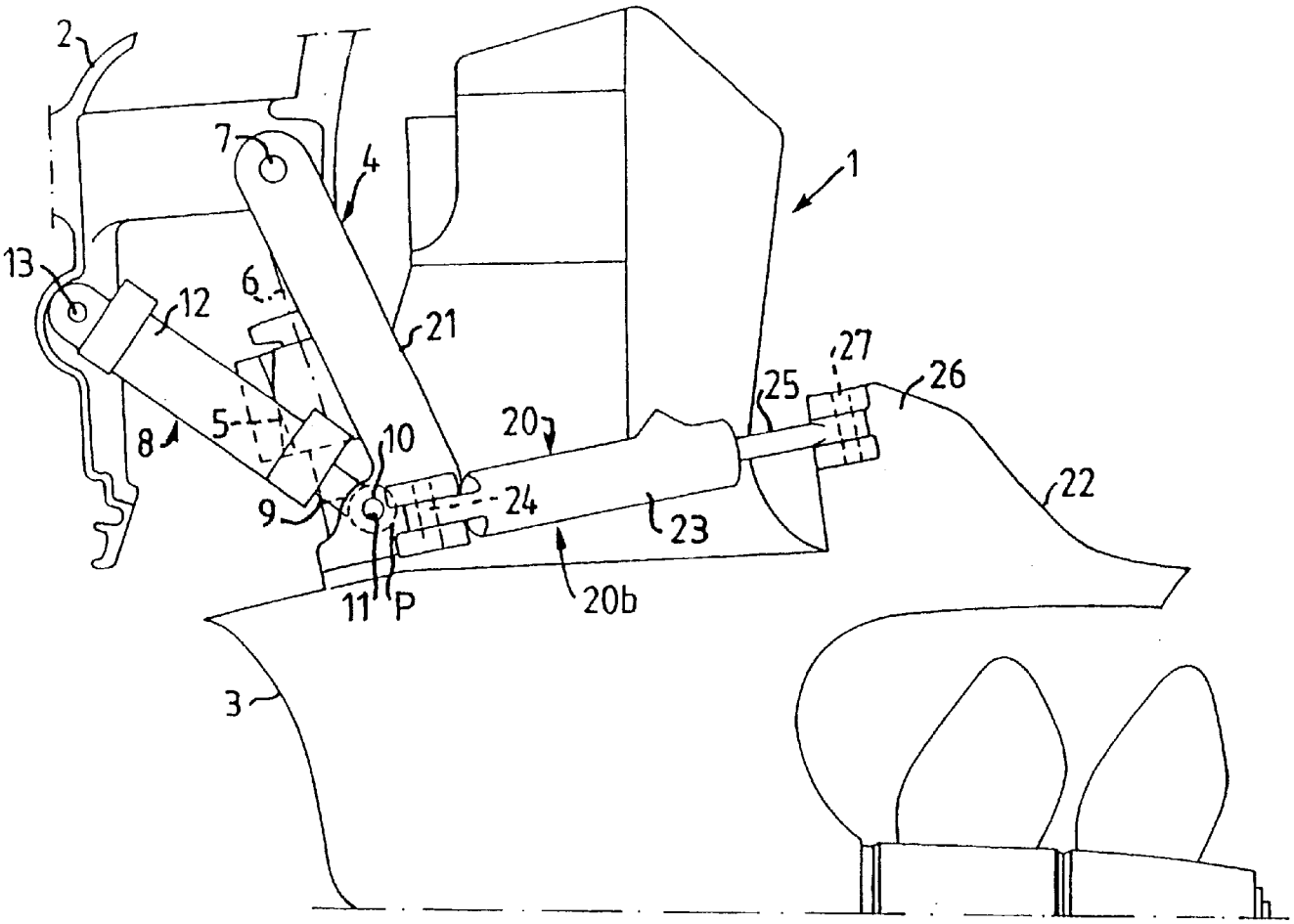
FIG. 1 shows a schematic side view of a boat propeller drive.

FIG. 1 shows an inboard/outboard drive 1 of Aquamatic® type, comprising a carrier or shell 2, intended to be fixed to the transom and seal against the edges of an opening of the transom. The drive 1 has a rig leg 3, which is pivotally suspended in a fork-like carrying element 4 via a shaft 5, the center axis 6 of which forms the steering axis of the drive. The fork element 4 is journalled at its upper end in the shell 2 for pivoting about a horizontal axis 7. At its lower end, the fork element 4 engages a pair of piston cylinder devices 8 arranged symmetrically about the shaft 5, only one of which being shown in the figure. In the example shown, the piston rod 9 of the respective device 8 is pivotally joined to the element 4 via a pin 10 in a bore 11 in the respective fork leg of the element 4, while each respective hydraulic cylinder 12 is pivotally mounted in the shell 2 via a pin 13. The piston cylinder devices 8 form so-called trim- and tilt cylinders, by means of which the angle of the rig lea 3 can be trimmed during operation and by means of the rig leg can be swung up out of the water when at rest.

Figure 2:
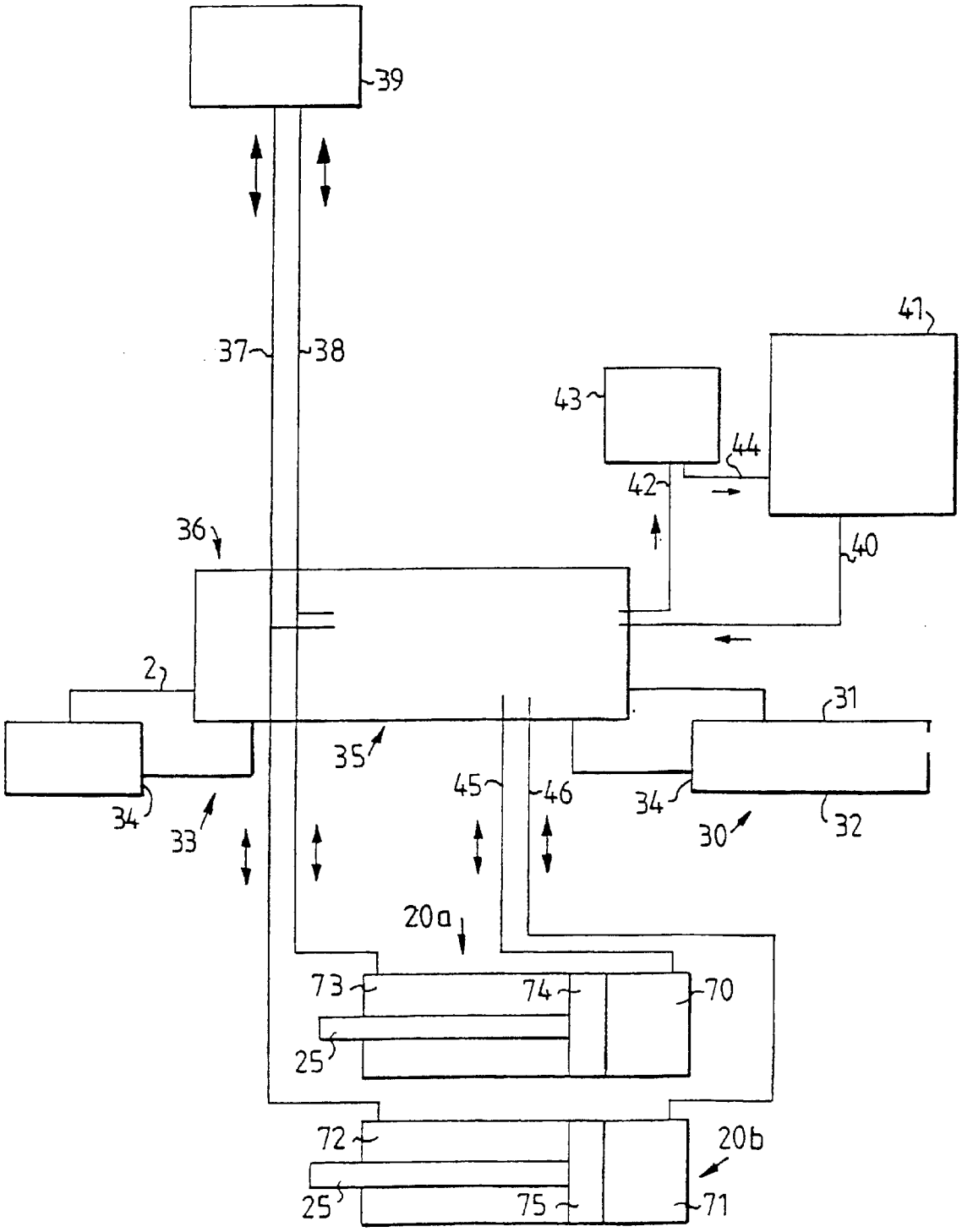
FIG. 2 shows a schematic drawing of one embodiment of a steering arrangement according to the invention for the propeller drive in FIG. 1.

Two hydraulic piston cylinder devices 20*a* and 20*b* oriented symmetrically relative to the longitudinal plane of symmetry of the drive. are pivotally joined to the lower end of each leo 21 of the fork element 4 and the cavitation plate 22 of the drive. In the example shown, the cylinder 23 of the respective piston cylinder device 20 is joined to the respective fork leg 21 by means of a pin 24 while the respective piston rod 25 is joined to a mounting 26 on the cavitation plate via a pin 27, The schematic drawing in FIG. 2 shows in cross-section a portion of a transom 30, where 31 designates its inside, 32 its outside and 33 a through-opening, against the edges 34 of which the shell 2 is sealingly fixed. In an opening 35 in the shell 2, a control valve 36 is sealingly fixed against the edges of the opening 35. The valve 36 communicates via lines 37 and 38 with a hydraulic pump 39 which is connected to a manual drive means (not shown in more detail here), e.g. a steering wheel, which, when turned, pumps hydraulic oil both to the control valve 36 and to and from cylinder chambers in the cylinders 20*a* and 20*b*, as will be described in more detail below with reference to FIGS. 3 and 4. The control valve 36 is also connected to a pressure line 40 from a hydraulic pump 41 driven by a drive motor (not shown) and via a line 42 to an oil reservoir 43, to which a suction line 44 to the pump 41 is connected. Oil can be pumped to and from cylinder chambers in the cylinders 20*a*, 20*b* via the control valve and the hydraulic lines 45, 46.

Figure 3:
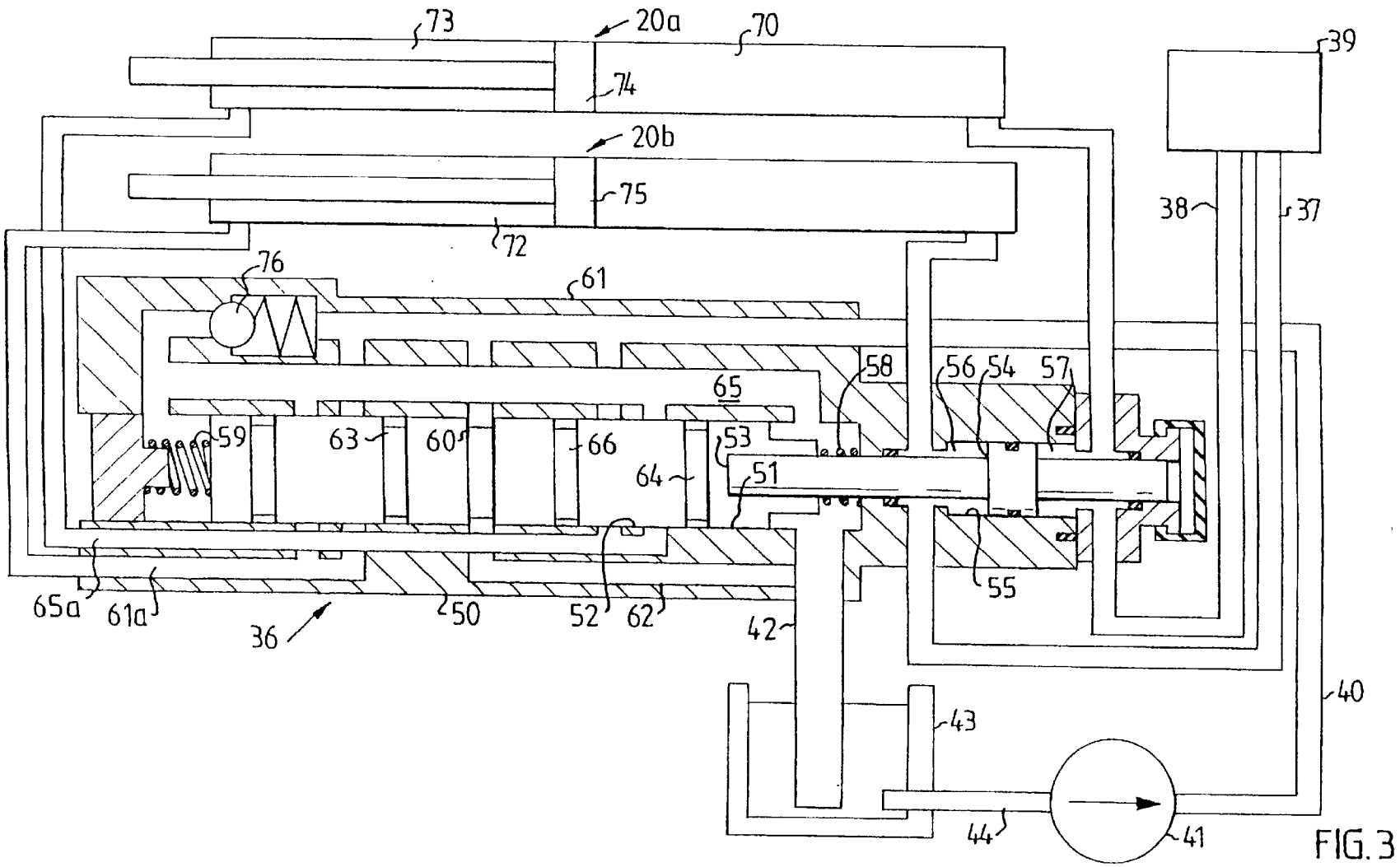
FIG. 3 shows a detailed schematic view of the control valve in FIG. 2 with associated components in the neutral position.
Figure 4:
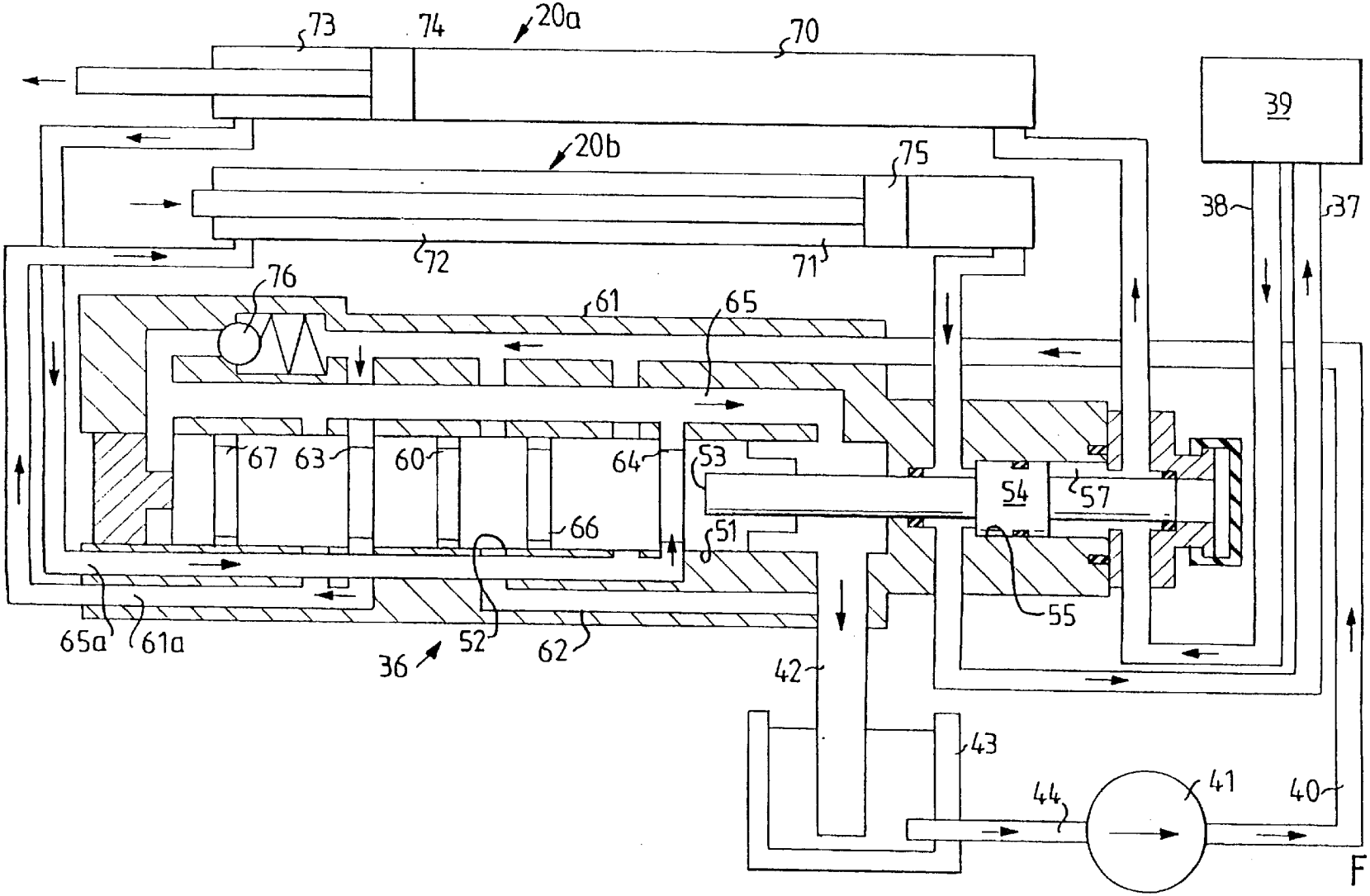
FIG. 4 shows a schematic drawing corresponding to FIG. 3 with associated components in position of turning.

FIGS. 3 and 4 show the control valve 36 with its hydraulic circuits in more detail. FIG. 3 illustrates the position of the components for driving straight ahead, when the pump 39 does not provide any flow or pressure. As can be seen in FIGS. 3 and 4, the control valve 36 has a valve housing 50, in which a valve slide 51 is displaceably disposed in a cylindrical bore 52. The slide 5l is joined to a piston rod 53 of the control piston 54. which is slidably disposed in a cylindrical bore 55. Cylinder chambers 56, 57 on either side of the control piston 54 communicate with the hydraulic pump 39 via the lines 37, 38. When the pump 39 does not produce any flow and there is not pressure differential over the piston 54, the springs 58, 59 keep the valve slide 51 centered in the position shown in FIG. 3, in which the pressure line 40 and the suction line 42, 44 of the pump 41 are short-circuited in the control valve in that a ring groove 60 of the slide 51 joins the pressure channel 61 of the valve with its return channel 62 to the oil reservoir 43.

In FIG. 4, the manual pump 39 is driven by turning the steering wheel (not shown) so that a flow occurs in the direction indicated by the arrows, resulting in a flow to and a pressure increase in the cylinder chamber 57 of the control piston 54 and a flow out of the opposite cylinder chamber 56. This in turn results in a displacement of the control piston 54 to the left-hand position shown in FIG. 4. The flow through the cylinder chamber 57 supplies hydraulic fluid to the right-hand cylinder chamber 70 of the hydraulic cylinder 20*a*, at the same time as the same volume is drained from the right-hand cylinder chamber 71 of the hydraulic cylinder 20*b* via the cylinder chamber 56 of the control piston. The displacement of the valve slide 51, caused by the control piston 54, results in a ring groove 63 in the slide 51 joining the pressure channel 61 of the valve with the left-hand cylinder chamber 72 of the cylinder 20*b*, at the same time as a ring groove 64 in the slide 51 joins the left-hand cylinder chamber 73 of the cylinder 20*a* with a return channel 65 to the return line 42. Oil is thereby supplied under high pressure from the motor-driven pump 41 to the left-hand cylinder chamber 72 of the cylinder 20*b* via a channel 61*a*, at the same time as oil is drained from the left-hand cylinder chamber 73 of the cylinder 20*a* via a channel 65*a*. In the cylinder 20*a* there is a relatively low working pressure created by the manual pump 39. This working pressure is equal to the control pressure on the control piston 54, but this pressure is also an operating pressure which provides a steering force contributing to the steering movement of the drive and is not only a pressure for controlling the control valve.

The major portion of the steering forces, however. comes from the high-pressure pump 41.

When the turning of the steering wheel stops and thus the flow from the steering wheel 39 ceases. there will occur a pressure equalization over the control piston 54. so that the springs 58, 59 will return the valve slide 51 to the neutral position, in which it short-circuits the high and low pressure sides of the high pressure pump 41. At the same time the connections of the cylinders 20*a*, 20*b* to the high and low pressure sides of the pump 41 are broken so that hydraulic blocking in the set position is obtained.

When turning the steering wheel in a direction opposite to that producing the flow indicated by arrows in FIG. 4, a flow is produced in the opposite direction, and the pressure increase in the cylinder chamber 56 caused by this flow causes a displacement of the control piston 54 and together therewith also the valve slide 51 to the right. This causes a ring groove 66 to connect the high pressure channel 61 of the valve to the cylinder chamber 73 of the cylinder 20*a* and a ring groove 67 to join the return channel 65 of the valve to the cylinder chamber 72 of the cylinder 20*b*. Thus the pistons 74, 75 in the steering cylinders 20*a* and 20*b* are adjusted in a direction opposite to that shown in FIG. 4.

As can be seen in FIGS. 3 and 4, the valve housing 50 contains a non-return valve 76 between the valve pressure channel 61 and the return channel 65. The non-retum valve 76 is a safety valve making possible completely manual emergency steering if the high pressure pump 41 should fail. If, in the state shown in FIG. 4, a pressure failure should occur in the pressure channel 61, oil must be able to be supplied to the pressure channel 61 by another path than from the pump 41 for oil to be able to be supplied to the cylinder chamber 72 of the cylinder 20*b*, at the same time as the cylinder chamber 73 in the cylinder 20*a* must be able to be drained, when the pressure generated manually in the cylinder chamber 70 strives to displace the piston 74 to the left in FIG. 4. Otherwise the system will lock hydraulically. The non-return valve 76 permits overflow from the return channel 65 to the pressure channel 61 so that the piston 75 during its movement in the cylinder 20*b* can draw oil via the non-return valve 76 from the return channel 65 via the pressure channel 61 to the cylinder chamber 72.

Figure 7:
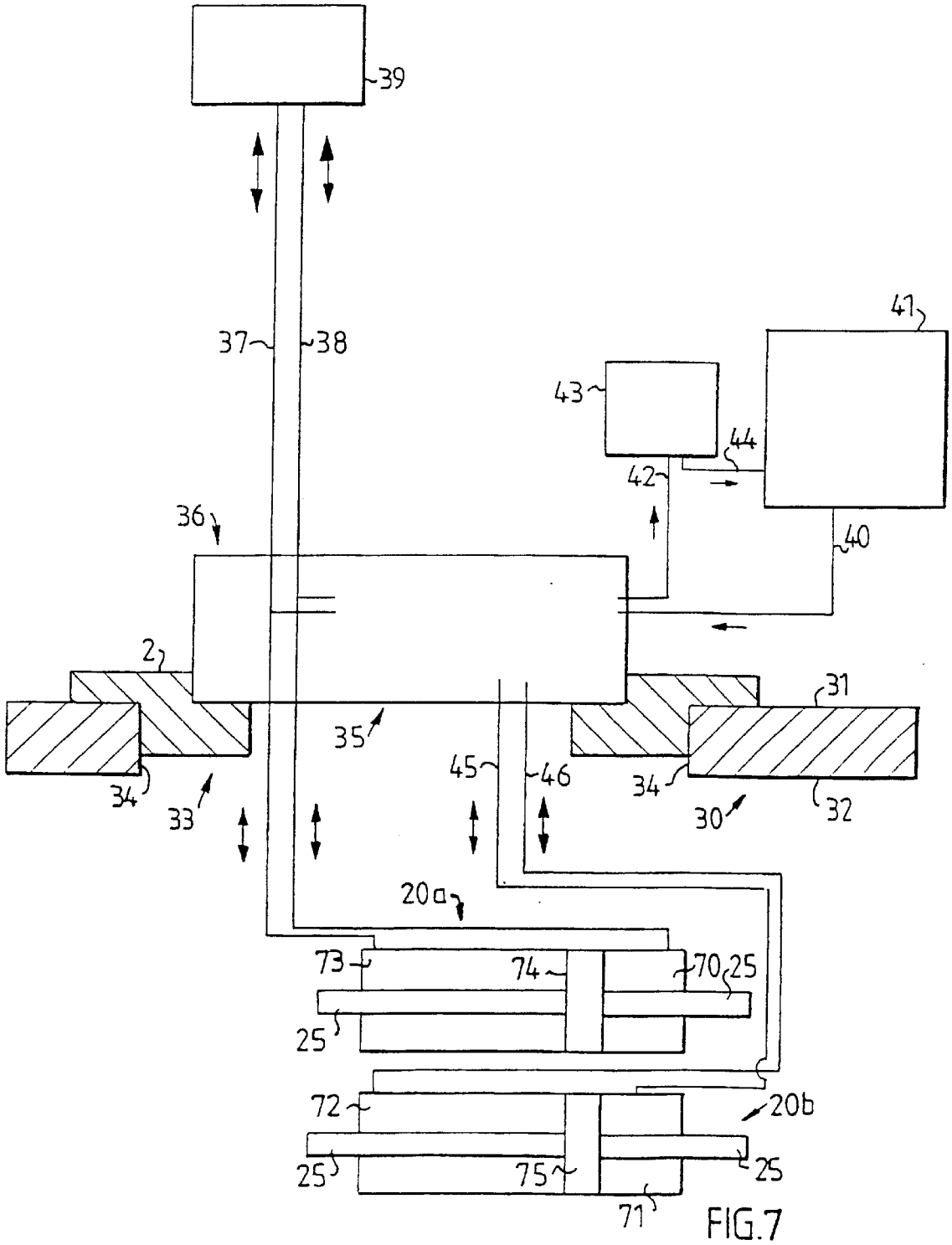
FIG. 7 is a diagram corresponding to FIG. 2 of a second embodiment of the steering arrangement according to the invention.

In the embodiment shown in FIG. 2, the low pressure circuit 37.3 8 between the pump 39 and the cylinders 20*a*, 20*b* is connected to the cylinder chambers 72, 73 on the piston rod side, while in the embodiment shown in FIGS. 3 and 4, the low pressure circuit 37, 38 is connected to the cylinders chambers 70, 71 on the piston side. The choice is dependent on what mechanical advantage is desired, i.e. weighing manual steering force and the number of rotations of the steering wheel to produce a certain steering deflection. The latter embodiment provides higher manual steering force but requires, on the other hand, more rotations of the steering wheel for a certain steering deflection of the drive unit. In an alternative embodiment shown in FIG. 7, the low pressure pump 39 is connected to both cylinder chambers 70, 73 of one cylinder 20*a*, and the high pressure pump 41 is connected via the control valve to the two cylinder chambers 71, 72 of the second cylinder 20*b*. In this embodiment, at least the cylinder 20*a* on the low pressure side requires a piston 74 with piston rods 25 in both cylinder chambers, to obtain the same effective piston area on both sides of the piston. A certain minor leakage can be allowed between the high and low pressure sides without risking the function.

Figure 5:
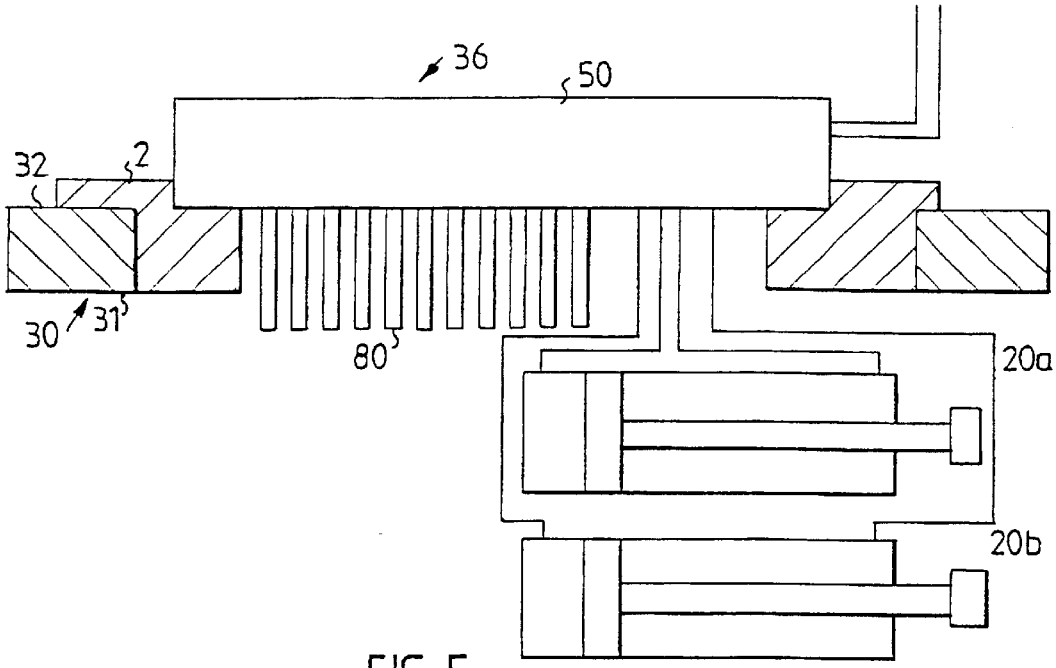
FIG. 5 is a schematic drawing of a first embodiment of an arrangement for oil cooling.
Figure 6:
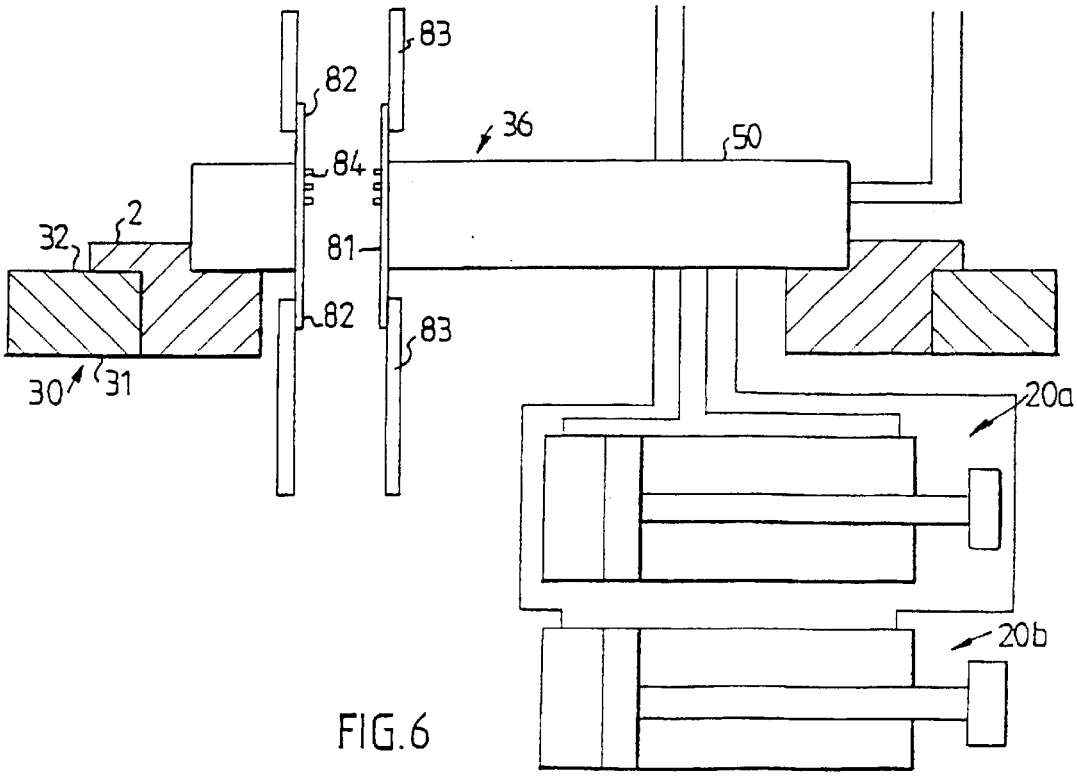
FIG. 6 is a schematic drawing of a second embodiment of an arrangement for oil cooling.

As can be seen in FIG. 2, the control valve 36 is mounted in an opening in the shell 2, so that its outside is subjected to water spray. This design allows the valve 36 to serve as an oil cooler for the hydraulic oil in the system and, at least in certain installations, it can completely replace a separate oil cooler. In order to increase the cooling capacity of the control valve 36, it can be provided with cooling flanges 80 as shown in FIG. 5 or, as shown in FIG. 6, it can be made with a channel 81 extending through the housing 50 and having at each end connections 82 for coolant hoses 83 to the engine coolant. The channel 81 can possibly also be provided with cooling flanges 84.

The steering arrangement according to the invention is of course not limited to marine applications, e.g. propeller drives, water jet units or rudders, but can also be used for steering land-based vehicles.

What is claimed is:

1. Servo-assisted steering arrangement for a flow body (1) pivotable about a steering shaft (5), comprising, in a hydraulic circuit (37, 38, 40, 42, 44), a first hydraulic pump (39) driven by a manual drive means, at least two double-acting hydraulic piston-cylinder devices (20*a*, 20*b*) connected in the hydraulic circuit, each having a cylinder chamber (70–73) on either side of respective pistons (74, 75), said piston-cylinder devices being connected between the pivotable flow body and a body fixed relative to a boat hull, and a second hydraulic pump (41) coupled into the hydraulic circuit, said second hydraulic pump being driven by a drive motor, the hydraulic circuit being divided into two, at least essentially mutually separated first and second partial circuits with the first hydraulic pump in the first partial circuit and the second hydraulic pump in the second partial circuit, characterized in that the partial circuits (37, 38 and 40, 42, 44, respectively) are so connected to a control valve means (36) and to their individual pair of cylinder chambers (70, 71 and 72, 73, respectively) that a flow in the first partial circuit is directed to one cylinder chamber of the associated pair of cylinder chambers (70, 71 and 72, 73) via the control valve means (36), which at a predetermined pressure open the communication between the second hydraulic pump (41) and one of the cylinder chambers of the associated pair of cylinder chambers (72, 73 and 70, 71), so that the pistons (74, 75) in the respective piston cylinder devices (20*a*, 20*b*) are displaced in a direction dependent on the flow direction in the first partial circuit.

2. Steering arrangement according to claim 1, characterized in that the first hydraulic pump (39) communicates with one cylinder chamber (70, 71) in each piston-cylinder device (20*a*, 20*b*), while the second hydraulic pump (41) communicates, via the control valve means (36) with the other cylinder chamber (72, 73) in each piston-cylinder device.

3. Steering arrangement according to claim 1, characterized in that the first hydraulic pump (39) communicates with each cylinder chamber in one piston-cylinder device, while the second hydraulic pump (41), via the control valve means (36) communicates with each cylinder chamber in the other piston-cylinder device.

4. Steering arrangement according to claim 1, characterized in that the piston-cylinder devices (20*a*, 20*b*) are connected between the pivotable body (1) and the fixed body (2) so that the steering shaft (5) is disposed between the piston-cylinder devices (20*a*, 20*b*) and that the partial circuits (37, 38 and 40, 42, 44, respectively) are so connected to the respective cylinder chambers (70–73) that the flow and pressure in the respective partial circuits strive to displace the respective pistons (74, 75) in opposite directions.

5. Steering arrangement according to claim 4, characterized in that the pivotable body (1) is a propeller drive leg and the fixed body is a shell (2) joined to a boat transom.

6. Steering arrangement according to claim 4, characterized in that the pivotable body is a rudder blade.

7. Steering arrangement according to claim 4, characterized in that the control valve (36) has a valve housing (50), which is so fixed relative to the boat hull that at least a portion of the valve housing is exposed to the hull surroundings.

8. Steering arrangement according to claim 7, characterized in that the valve housing (50), at least on the side exposed to the hull surroundings, is provided with cooling flanges (80).

9. Steering arrangement according to claim 7, characterized in that the valve housing (50) is made with a through-channel (81), which has an inlet and an outlet (82) for coupling in a coolant line (83).

10. Steering arrangement according to claim 7, characterized in that the valve housing (50) is sealingly fixed in a through-opening in a shell (2) joined to a boat transom.

11. Steering arrangement according to claim 1, characterized in that the manual drive means is a boat-steering wheel.

12. Steering arrangement according to claim 1, characterized in that the control valve (36) is a slide valve having a valve slide (51) spring-biased towards a neutral position, said valve slide in the neutral position breaking the communication between the second hydraulic pump (41) and said pair of cylinder chambers (72, 73) and being joined to a control piston (54) displaceable in a cylinder (55) having, on opposite sides of the control piston, cylinder chambers (56, 57) communicating with the first hydraulic pump (39), so that a pressure generated by the first hydraulic pump in one of the cylinder chambers strives to displace the control piston and thus the valve slide in one of two open positions determined by the flow direction of the first pump, in which positions the second hydraulic pump communicates with said pair of cylinder chambers (72, 73).

13. Steering arrangement according to claim 12, characterized in that the control valve (36) comprises non-return valve means (76) which, upon pressure failure in the pressure side (61) of the second hydraulic pump (41), permit flow from the suction side (65) of the pump to its pressure side (61), when the pressure on the suction side exceeds the pressure on the pressure side.

14. Hydraulic control valve for a steering device according to claim 1, comprising a valve housing, a valve slide which is displaceable in said housing and which is spring-biased towards a neutral position, in which it breaks the communication between the inlet to and the outlet from the valve housing and a control piston which is joined to the valve slide and is displaceable in a cylinder in the valve housing, said cylinder having, on opposite sides of the control piston, cylinder chambers each having an inlet and an outlet so that a pressure in either cylinder chamber strives to displace the control piston and thus the valve slide to one of two open positions, characterized in that the valve slide (51) in one of said two positions establishes communication between a valve housing inlet (40) intended to be connected to the high pressure side in a hydraulic circuit, and one of two connections **(61*a* or 65*a*) intended to be connected to individual pressure medium-actuated devices (20*a*, 20*b*), at the same time as communication is established between the second connection (65*a* or 61*a*) and an outlet (42) from the valve housing intended to be connected to the low pressure side of the hydraulic circuit, non-return valve means (76) arranged in the valve housing permitting, if there is pressure failure on the high pressure side (61)**, flow from the low pressure side to the high pressure side when the pressure on the low pressure side exceeds the pressure on the high pressure side.

* * * * *